US007004673B2

(12) United States Patent
Sapozhnikov

(10) Patent No.: US 7,004,673 B2
(45) Date of Patent: Feb. 28, 2006

(54) ASPHALT CONCRETE PAVEMENT WITH CONCRETE SUBBASE WITH THE ENRICHED QUARRY LIMESTONE WASTE AS A COARSE AGGREGATE

(76) Inventor: Naum Sapozhnikov, 1550 N. Poinsettia Pl., #210, Los Angeles, CA (US) 90046

( * ) Notice: Subject to any disclaimer, the term of this patent is extended or adjusted under 35 U.S.C. 154(b) by 0 days.

(21) Appl. No.: 10/790,646

(22) Filed: Mar. 1, 2004

(65) Prior Publication Data

US 2004/0197145 A1 Oct. 7, 2004

Related U.S. Application Data

(60) Provisional application No. 60/451,843, filed on Mar. 4, 2003.

(51) Int. Cl.
*E01C 3/00* (2006.01)

(52) U.S. Cl. ..... 404/31

(58) Field of Classification Search ..... 404/17, 404/71, 72, 27, 31; 106/738; 264/228
See application file for complete search history.

(56) References Cited

U.S. PATENT DOCUMENTS 3,587,964 A * 6/1971 Cork ..... 238/92
4,101,332 A * 7/1978 Nicholson ..... 588/256
4,174,912 A * 11/1979 Peterson ..... 404/27
4,357,169 A * 11/1982 Trujillo ..... 160/284.01
4,523,755 A * 6/1985 Turba ..... 472/92
4,836,856 A * 6/1989 Klco ..... 404/76
4,909,662 A * 3/1990 Baker ..... 404/31
5,037,480 A * 8/1991 Baker ..... 106/816
6,346,146 B1 * 2/2002 Duselis et al. ..... 106/713
6,706,108 B1 * 3/2004 Polston ..... 106/285

OTHER PUBLICATIONS

Sapozhnikov N. Safety of Precast Reinforced Concrete and Prestressed Structural Members by the Second Limit State (Serviceability Limit State). State Committee of Construction of the USSR Institute of Information, Moscow, 1991.
Thickness Design for Concrete Highway and Street Pavements, Portland Cement Association, pp. 5, 36-38, undated.

* cited by examiner

*Primary Examiner*—Gary S. Hartmann
(74) *Attorney, Agent, or Firm*—John F. Wagner; Robert C. Smith

(57) ABSTRACT

Asphalt concrete pavement consisting of an asphalt surface course, concrete subbase of specified compressive strength $f_{c'}$ and modulus of rupture up to 5,000 and 750 psi, respectively, with small grains crushed limestone finer than 9.5 mm as a coarse aggregate, and a layer of granular material between the surface course and concrete subbase is considered as a semi-rigid pavement. Rigidity of this composite structure is provided by the concrete subbase whereas its flexibility is provided by the asphalt surface course resting on the layer of granular material.

12 Claims, 1 Drawing Sheet

Figure 1:
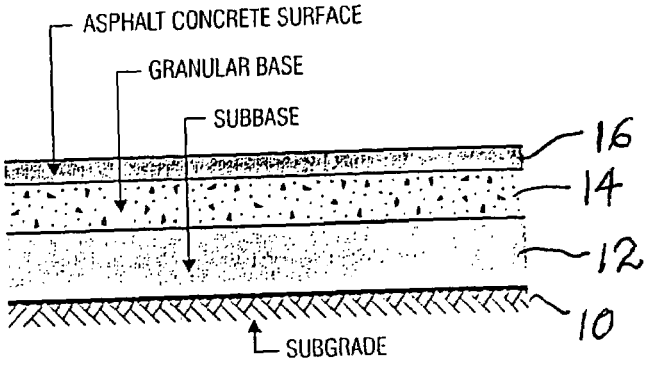

ASPHALT CONCRETE PAVEMENT WITH CONCRETE SUBBASE WITH THE ENRICHED QUARRY LIMESTONE WASTE AS A COARSE AGGREGATE

REFERENCE TO RELATED APPLICATION

Provisional Patent Application No. 60/451,843 Filing Data Mar. 4, 2003

FEDERALLY SPONSORED RESEARCH

Not Applicable

SEQUENCE LISTING PROGRAM

Not Applicable

BACKGROUND

1. Field of Invention

Design and construction of road and street asphalt pavements with concrete subbase.

2. Description of Prior Arts

Asphalt pavements constitute near 90% of US road construction. It can be explained by the comparatively moderate initial cost of these pavements; it is less than that for concrete pavements by 20% on average. However maintenance cost of asphalt pavements is considerably higher than that for concrete pavements. Cracking and consequent failure of asphalt surface course of asphalt pavement are caused usually by considerable deformations of crushed stone or other granular materials subbase and base course of this pavement. Moreover, damages of asphalt pavement can be caused by the fatigue stresses of surface course due to deformations of lower courses of this pavement.

Deformations of flexible lower courses of asphalt pavement should be limited to reduce cracking of the surface course of this pavement. It can be achieved by the use of concrete subbase or at least cement treated subbase instead of crushed stone the base course of flexible pavement should remain flexible. The increase of rigidity of asphalt pavement should reduce the cracking of surface course with the corresponding reduction of the maintenance cost of this pavement. It is important to reach reduction of the maintenance cost of this pavement without consideration increase of its initial cost due to use of concrete subbase instead of the crushed stone one.

The cost of concrete subbase s determined by the value of flexural strength of concrete, which is estimated by the value of modulus of rupture. The choice of modulus of rupture of concrete of subbase is determined merely by the economical reasons. Asphalt pavement is a composite structure, and the increase of capacity of subbase means the corresponding increase of capacity of pavement as a whole.

As applied to composite concrete pavement the increase of flexural strength of lean concrete subbase or lower layer means the possibility of the corresponding reduction of normal concrete surface course of this pavement. Design procedure of the normal concrete pavement results in the certain value of normal concrete thickness. The sense of composite concrete pavement of the identical capacity is in the reduction of consumption of normal concrete with high cost crushed granite as a coarse aggregate by replacing of a part of this concrete by subbase or lover layer cheaper concrete.

The increase of capacity of pavement depending on the increase of flexural strength of subbase can be estimated by the example of composite concrete pavement designed according to Portland Cement Association Engineering Bulletin (Thickness Design for Concrete Highway and Street Pavements, Portland Cement Association, EB 109P). This design procedure indicates a thickness for two-layer concrete pavement equivalent to a given thickness of normal concrete.

Increase of equivalent normal concrete thickness of composite pavement due to increase of flexural strength of concrete subbase can be considered approximately as a measure of possible reduction of thickness of normal concrete surface course of this pavement. The design chart for composite concrete pavement with lean concrete subbase of modulus of rupture in the range from 150 to 450 psi is presented on the FIG. B1, Appendix 2 of said Portland Cement Association Engineering Bulletin. It allows estimation of equivalent normal concrete thickness of composite concrete pavement corresponding to the different combinations of thickness of lean concrete subbase and normal concrete surface course of pavement.

The estimations of equivalent normal concrete thickness of pavement corresponding to the lean concrete 4-inch thickness subbase of modulus of rupture in the range from 150 to 450 psi and different values of thickness of surface course were determined according to this design chart. It allows estimation of the change of equivalent thickness of composite pavement depending on the change of lean concrete flexural strength of subbase. Moreover, relative increase of this thickness depending on the increase of modulus of rupture of lean concrete of subbase were carried out. The equivalent normal concrete thickness corresponding to the value of modulus of rupture equal to 150 psi is considered as 1,0. Results of these calculations are presented in Table 1.

As can be seen from the Table 1, equivalent normal concrete thickness of composite pavement is increased at least 15% due to the increase of modulus of rupture of concrete of subbase from 150 to 450 psi. It can be considered as estimation of corresponding reduction of the thickness of normal concrete surface course.

TABLE 1

| | Modulus of rupture of normal concrete of surface course in the range 600 to 700 psi Modulus of rupture of 4-inch thickness lean concrete subbase, psi | | | | Modulus of rupture of normal concrete of surface course in the range 500 to 600 psi Modulus of rupture of 4-inch thickness lean concrete subbase, psi | | | |
|---|---|---|---|---|---|---|---|---|
| Thickness of normal concrete surface course (inch) | 150 | 250 | 350 | 450 | 150 | 250 | 350 | 450 |
| | Equivalent normal concrete thickness of composite pavement (inch) and relative increase of this thickness depending on the increase of modulus of rupture of lean concrete of subbase (equivalent normal concrete thickness corresponding to the value of modulus of rupture equal to 150 psi is considered as 1.0) | | | | | | | |
| 7 | 8.5/1.0 | 9.1/1.07 | 9.5/1.12 | 9.9/1.2 | 8.6/1.0 | 9.2/1.07 | 10.0/1.16 | 10.4/1.2 |

TABLE 1-continued

| Thickness of normal concrete surface course (inch) | Modulus of rupture of normal concrete of surface course in the range 600 to 700 psi Modulus of rupture of 4-inch thickness lean concrete subbase, psi | | | | Modulus of rupture of normal concrete of surface course in the range 500 to 600 psi Modulus of rupture of 4-inch thickness lean concrete subbase, psi | | | |
|---|---|---|---|---|---|---|---|---|
| | 150 | 250 | 350 | 450 | 150 | 250 | 350 | 450 |
| | Equivalent normal concrete thickness of composite pavement (inch) and relative increase of this thickness depending on the increase of modulus of rupture of lean concrete of subbase (equivalent normal concrete thickness corresponding to the value of modulus of rupture equal to 150 psi is considered as 1.0) | | | | | | | |
| 8 | 9.6/1.0 | 10.2/1.07 | 10.7/1.11 | 11.2/1.16 | 9.8/1.0 | 10.5/1.07 | 11.0/1.12 | 11.5/1.17 |
| 9 | 10.6/1.0 | 11.3/1.07 | 11.8/1.11 | 12.3/1.16 | 10.9/1.0 | 11.5/1.06 | 12.2/1.12 | 12.6/1.16 |
| 10 | 11.6/1.0 | 12.4/1.07 | 12.9/1.11 | 13.4/1.16 | 11.9/1.0 | 12.6/1.06 | 13.4/1.12 | 13.8/1.16 |

The same results were obtained by estimation of the ratio of equivalent normal concrete thickness of composite pavement to physical one depending on the change of flexural strength of lean concrete of subbase. Average estimations of this ratio corresponding to the values of modulus of rupture of concrete in the range from 150 to 450 psi are presented in the Table 2.

TABLE 2

| Thickness of lean concrete subbase in. | Modulus of rupture of normal concrete of surface course in the range 600 to 700 psi Modulus of rupture of lean concrete of subbase, psi | | | | Modulus of rupture of normal concrete of surface course in the range 500 to 600 psi Modulus of rupture of lean concrete of subbase, psi | | | |
|---|---|---|---|---|---|---|---|---|
| | 150 | 250 | 350 | 450 | 150 | 250 | 350 | 450 |
| | Ratio between equivalent normal concrete thickness of composite concrete pavement and physical one of this pavement | | | | | | | |
| 4 | 0.803 | 0.856 | 0.902 | 0.936 | 0.829 | 0.877 | 0.923 | 0.962 |
| 5 | 0.786 | 0.835 | 0.897 | 0.912 | 0.810 | 0.858 | 0.906 | 0.950 |
| 6 | 0.707 | 0.819 | 0.864 | 0.864 | 0.793 | 0.840 | 0.895 | 0.944 |

It is evident that the increase of flexural strength of concrete subbase is efficient as applied to composite concrete pavements. It can be efficient for asphalt pavements as composite structures.

The compressive and flexural strengths of lean concrete are determined to a great extent by the quality of coarse aggregate. Lean concrete can be produced when local or recycled, relatively cheap coarse aggregates are available; the cost of concrete is determined to a large degree by the cost of coarse aggregate. The use of cheap small grains coarse aggregates is the one of the ways of obtaining of lean and not only lean concrete.

Small grains crushed limestone is one of the cheapest aggregates. According to the US Geological Survey, crushed limestone constitutes 71% of total weight of coarse aggregates for concrete produced in USA. This product of grading finer than 9.5 mm usually is not used as a coarse aggregate. Utilization of great deposits of crushed limestone finer than 9.5 mm and especially finer than 4.75 mm (from 10 to 25% of the total volume of quarrying) are urgent for aggregate industry. The object of design of composite concrete pavements is to obtain the highest concrete strength of subbase and lower layer of this pavement with the cheapest coarse aggregate and with the moderate consumption of cement.

Crushed limestone of regular sizes is most popular coarse aggregate concrete in the US building practice. The choice of coarse aggregate cheaper than crushed limestone of regular sizes, which does not require additional consumption of cement, is the way to reduce cost of concrete subbase of asphalt pavement and this pavement as a whole.

OBJECTS AND ADVANTAGES

The main object of the present invention is to obtain highway and street asphalt pavement with concrete subbase. Coarse aggregate of this concrete is a processed by-product of manufacture crushed limestone of regular sizes defined as enriched limestone waste of grading intermediate between coarse and fine aggregates in Terminology of ASTM C125. Concrete of subbase with this coarse aggregate is characterized by specified compressive strength and modulus of rupture up to 5,000 and more than 750 psi, respectively. The use of this concrete for subbase and limitation of deformations of the asphalt surface course due to the choice of the reasonable rigidity of base course allow obtaining of pavement intermediate between rigid and flexible pavements. The initial cost of this pavement should be close to that for flexible pavement of the same capacity. The maintenance cost of this pavement is higher than that for rigid pavement but considerably higher than that for flexible pavement of the same capacity.

Another important object of the present invention is to obtain concrete for subbase of highway and street asphalt concrete pavement with crushed limestone as a coarse aggregate of grading corresponding to that for the largest Size of fine aggregate Number 9. This grading of enriched limestone waste is result of adverse conditions of handling and transportation of aggregate from quarry to concrete plant. Crushed limestone of this grading can be used as a coarse aggregate for concrete. However the excessive degradation of aggregate causes the loss of strength of concrete, which should be compensated by additional consumption of cement.

The most important object of present invention is to obtain concrete of specified compressive strength and modulus of rupture up to 5,000 and more than 750 psi, respectively, with the coarse aggregate as a processed by-product of regular sizes crushed limestone manufacture defined as enriched limestone waste. Grading of this aggregate is intermediate between coarse and fine aggregates in Terminology of ASTM C125. Compressive and flexural strength of concrete with this coarse aggregate should be higher or at least close to that for concrete of the same consumption of cement with crushed granite of regular sizes as a coarse aggregate.

The main advantage of present invention is possibility to use the processed by-product of manufacture of regular sizes of crushed limestone as a coarse aggregate. Enriched limestone waste of grading intermediate between coarse and fine aggregates in Terminology of ASTM C125 can be used instead of crushed limestone and even crushed granite of regular sizes as a coarse aggregate. Cost of this aggregate is approximately one half and one fourth of the cost of crushed limestone and crushed granite of regular sizes, respectively. Consumption of cement of concrete with this coarse aggregate is less or at least not higher than that for concrete of the same compressive and flexural strength with crushed granite of regular sizes as a coarse aggregate.

Another important advantage of present invention is possibility to use enriched limestone waste of grading corresponding to the largest Size of fine aggregates number 9 as a coarse aggregate for concrete of subbase but with increased consumption of cement. This grading is result of adverse conditions of transportation of aggregate to concrete plant. Excessive degradation of aggregate grading does not eliminate the possibility of the use of this aggregate; it only requires additional consumption of cement to compensate this degradation.

SUMMARY OF INVENTION

Asphalt concrete pavement includes concrete subbase with coarse aggregate defined as enriched limestone waste of grading intermediate between coarse and fine aggregates in Terminology of ASTM C125. Concrete of subbase with this coarse aggregate is characterized by specified compressive strength $f_c'$ and modulus of rupture (MR) up to 5,000 and more than 750 psi, respectively. This aggregate is processed by-product of manufacture of crushed limestone of regular Sizes Number 56, 57, 6, and 67 with the rated dimensions 25–9.5 mm, 25–4.75 mm, 19–9.5 mm, and 19–4.75 mm, respectively. The aim of enrichment of limestone quarry waste is the reduction of small sizes of grains. Enrichment of this aggregate should be carried out by washing or screening, or by combination of washing and screening. Method of enrichment depends on the grading of aggregate and should be selected by economical reasons.

Limestone quarry waste as a raw material for enrichment should be finer than 9.5 mm but coarser than 4.75 mm. The amount of aggregate finer than 4.75 mm (Sieve No.4) before enrichment should be at least the value of the same order as that for the least Size of coarse aggregate number 89 according to ASTM C33, and it should be not less than ⅓ of the total weight of aggregate. After enrichment the main part of aggregate finer than 4.75 mm should be coarser than 2.36 mm. The amount of aggregate finer than 2.36 mm (Sieve No.8) should not exceed about 10%; the amount of aggregate finer than 1.18 mm (Sieve No.16) should not exceed about 7%; the amount of aggregate finer than 300 $\mu$m (Sieve No.50) should not exceed about 2%.

Handling and transportation of enriched limestone waste from a quarry to the aggregate bin of a concrete plant causes inevitable breakdown of aggregate. Due to weather effects and other impacts such as loading and discharge, grading of enriched limestone waste may become unpredictable. However, few parameters of grading of enriched limestone waste after transportation from a quarry to the aggregate bin of a concrete plant should be controlled in the framework of the present invention. The amount of aggregate finer than 4.75 mm (Sieve No.4) should be less than that for largest Size of fine aggregate Number 9 according to ASTM C33. It should be close to but not exceed ⅔ of the total weight of aggregate. The amount of aggregate finer than 300 $\mu$m (Sieve No.50) should not exceed about 3.0%. Grading of enriched limestone waste after transportation from a quarry to the aggregate bin of a concrete plant can be considered as intermediate between coarse and fine aggregates in the Terminology of ASTM C125.

Enriched limestone waste is one of the cheapest aggregates. However the use of concrete with this coarse aggregate for subbase and limitation of deformation of asphalt surface course by the choice of reasonable rigidity of base course allows obtaining of pavement intermediate between rigid and flexible pavement. Initial cost of this pavement should be close to that for flexible pavement with treated or non-treated granular subbase. Maintenance cost of this pavement is higher than that for rigid pavement, and it should be considerably less than that for flexible pavement. It means the increase of competitiveness of asphalt pavement as compared with concrete pavements.

Moreover, the use of concrete with this coarse aggregate allows very profitable utilization of great deposits of crushed limestone finer than 9.5 mm usually estimated as limestone quarry waste and especially aggregate finer than 4.75 mm. In so doing the volume of utilized aggregate finer than 4.75 mm should constitutes at least ⅓ of the utilized volume of aggregate finer than 9.5 mm. Utilization of limestone waste enables to reduce quarrying of high-quality aggregate with corresponding conservation of environment.

DETAILED DESCRIPTION OF PREFERRED EMBODIMENT

FIG. 1 is a cross-sectional view of a typical prior art flexible pavement with an asphalt surface. This drawing is essentially the same as that appearing in the "Standard Handbook for Civil Engineers", McGraw Hill Co, current edition.

The prior art pavement may or may not require a separate subgrade 10. Laid on the subgrade 10 is a subbase 12, typically a compacted layer of granular material. Next is a granular base 14 which is directly under the asphalt surface 16 which is of aggregates such as crushed stone, crushed slag, gravel and sand, or a combination of these.

Figure 2:
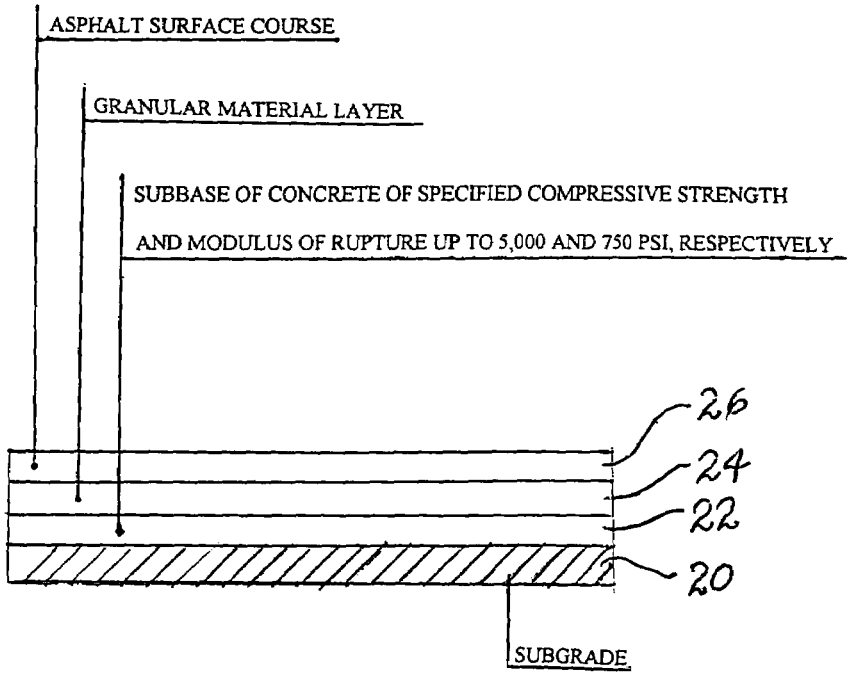

FIG. 2 is a cross-sectional view of a semi-rigid pavement according to the invention. A subgrade 20 may or may not be required. The subbase 22 is of concrete as described in detail below. The granular base 24 is or may be of exactly the same material as the granular base 14 described above. Above the granular base 24 is asphalt surface course 26.

Asphalt concrete pavement includes a concrete subbase 22 with coarse aggregate defined as an enriched limestone quarry waste of grading intermediate between the course and fine aggregates in Terminology of ASTM C125. This aggregate is a processed by-product of manufacture of crushed limestone of regular sizes. Concrete with this coarse aggregate is characterized by the specified compressive strength $f^{c1}$ and modulus of rupture (MR) up to 5,000 and more than 750 psi, respectively.

Cost of enriched limestone quarry waste as a coarse aggregate of this grading is approximately one half and one fourth of the cost of crushed limestone and crushed granite of regular sizes as a coarse aggregate, respectively. Consumption of cement for concrete with this coarse aggregate is less or at least close to that for concrete of the same compressive and flexural strength with crushed granite of regular sizes as a coarse aggregate. Compressive and flexural strength of concrete with this coarse aggregate is higher at least by 10% than that for concrete of the same consumption of cement with crushed limestone as a coarse aggregate of grading corresponding to that for the least Size of coarse aggregate Number 89 according to ASTM C33.

This coarse aggregate is especially efficient for lean concrete. Flexural strength of concrete of minimum consumption of cement equal to 120 kg per cubic meter (near 200 pounds per cubic yard) with this coarse aggregate is higher than that for concrete of the same consumption of cement with crushed limestone of regular sizes as a coarse aggregate.

Capacity of such composite structure as asphalt pavement can be estimated as the sum of capacities of layers of this pavement. Capacity of concrete subbase 22 of the certain thickness is determined by flexural strength of concrete. The increase of capacity of subbase 22 means the possibility of corresponding reduction of capacity of the more expensive asphalt surface course 22. Thus, concrete strength of subbase 22 is determined merely by the economical reasons.

If rigidity of this pavement is determined by the rigidity of concrete subbase, flexibility of this pavement is determined by the flexibility of the base course. Though the asphalt surface course 26 is the flexible part of this composite structure, realization of its flexibility depends on the rigidity of the base course 22 of this pavement. The choice of the reasonable rigidity of base course allows the keeping of deformations of asphalt surface course 26 within the desirable limits. Rigidity of the base course 22 is determined by the thickness and quality of granular material of this course. Crushed limestone of grading finer than 4.75 mm can be used for the base course.

Limestone quarry waste is very cheap and an efficient coarse aggregate for concrete. Cost of lean concrete subbase with this coarse aggregate and minimum consumption of cement can not exceed considerably the cost of subbase of any granular treated material. Concrete of any strength with this coarse aggregate can be efficient for subbase, since increase of capacity of subbase means the possibility of reduction of asphalt surface course. Possible increase of cost of concrete subbase as compared with that for the usual granular subbase of asphalt pavement should be compensated by the reduction of asphalt surface course. Thus, the use of concrete subbase with this coarse aggregate does not mean the considerable increase of initial cost of pavement. At the same time, limitation of deformation of asphalt surface course should reduce cracking of this course and corresponding reduction of the maintenance cost of this pavement.

This pavement is intermediate between rigid and flexible pavements. The initial cost of this pavement should be close to that for the usual asphalt pavement. Its maintenance cost should be considerably less than that for the usual asphalt pavement but higher than that for concrete pavement. This pavement can be defined as semi-rigid or semi-flexible.

OPERATION OF PREFERRED EMBODIMENT

Design procedure according to the current practice of design of asphalt pavement with the estimation of initial cost of this pavement is required as a first step of operation of preferred embodiment of the present invention. Capacity of asphalt pavement is estimated as a sum of capacities of all courses of this composite structural member.

The replacing of the usual subbase by the concrete one means the increase of capacity of pavement as a whole. It means the possibility of corresponding reduction of capacity of thickness of asphalt surface course of pavement. Minimization of initial cost of pavement depending on the thickness and flexural strength of concrete subbase and thickness of asphalt surface course should be carried out by the trial-and-error method.

Minimization of the maintenance cost of pavement should be achieved by limitation of deformations of asphalt surface course and corresponding reduction of cracking of this surface. Since deformations of the surface course are determined by rigidity of the base course of this pavement, limitation of these deformations should be achieved by the choice of the reasonable rigidity of base course. Crushed limestone of grading finer than 4.75 mm can be used for base course.

DETAILED DESCRIPTION OF ADDITIONAL EMBODIMENT

Asphalt concrete pavement includes concrete subbase with the enriched limestone quarry waste as coarse aggregate. Requirements to limestone waste as a raw material for enrichment and requirements to grading of this aggregate after enrichment are the same as for enriched limestone waste of preferred embodiment of invention. Additional embodiment of invention provides the use for concrete subbase of enriched limestone waste as a coarse aggregate of grading corresponding to that for largest Size of fine aggregate Number 9 according to ASTM C33. This grading of coarse aggregate is result of adverse conditions of handling and transportation of this aggregate to aggregate bin of concrete plant.

Compressive and flexural strength of concrete with crushed limestone as a coarse aggregate of this grading is at least less by 10% than that for concrete with coarse aggregate of grading corresponding to the least Size of coarse aggregate Number 89. Strength of concrete with crushed limestone as a coarse aggregate of this grading is considerably less than that for concrete with coarse aggregate of grading intermediate between coarse and fine aggregates in Terminology of ASTM C125. This reduction of concrete strength should be compensated by corresponding increase of consumption of cement. The expediency of the use of concrete with coarse aggregate of this grading is determined by the cost of concrete depending on local conditions.

DETAILED DESCRIPTION OF YET ANOTHER ADDITIONAL EMBODIMENT

Concrete of specified compressive strength $f_c'$ and modulus of rupture (MR) up to 5,000 and more than 750 psi is produced with the coarse aggregate defined as enriched limestone quarry waste of grading intermediate between coarse and fine aggregates in the Terminology of ASTM C125. Physical properties of this coarse aggregate should be in accordance with requirements of the ASTM C33. Compressive strength of this concrete should be higher than that for concrete of the same consumption of cement with crushed limestone of the Size Number 89 as a coarse aggregate. Moreover, compressive strength of this concrete should be higher or at least close to that for concrete of the same consumption of cement and twice as high consumption of admixture with crushed granite of regular sizes as a coarse aggregate. Flexural strength of this concrete is higher than that for concrete of the same consumption of cement with crushed granite of regular sizes as a coarse aggregate.

Limestone quarry waste is a by-product of manufacture of crushed limestone of regular sizes mainly Numbers 56, 57, 6 and 67 of the rating dimensions 25–9.5 mm, 25–4.75 mm, 19–9.5 mm and 19–4.75 mm, respectively. As a raw material for enrichment it should be finer ⅜ in.(9.5 mm) and coarser than 4.75 mm (Sieve No.4). Proportion between the amounts of aggregate finer and coarser than 4.75 mm before enrichment is very important; the problem of utilization of aggregate finer than 4.75 mm is more urgent than that for part of this by-product coarser than 4.75 mm. Moreover, aggregate finer than 4.75 mm is considerably cheaper than part of this by-product coarser than 4.75 mm. According to the invention, the amount of aggregate finer than 4.75 mm at the quarry before enrichment should be at least the value of the same order as that for the least Size of coarse aggregate Number 89 according to the ASTM C 33 and not less than about ⅓ of the total weight of aggregate.

Proportion between the amounts of aggregate finer and coarser than 4.75 mm before enrichment should be determined taking into account an inevitable breakdown of this aggregate due to dry enrichment by screening and especially due to transportation of this aggregate to concrete plant. The breakdown of aggregate is caused by weather conditions (rain, frost, thawing) and handling of this aggregate (loading, discharge and other actions during transportation from quarry to aggregate bin of concrete plant). Due to the influence of scale effect this breakdown relates mainly to the portion of aggregate coarser than 4.75 mm. As a result, amount of aggregate finer than 4.75 mm in the aggregate bin of concrete plant can be considerably higher than at the quarry. The amount of this fraction in the aggregate bin of concrete plant should be close to but not exceed ⅔ of the total weight of aggregate. Transportation of very vulnerable enriched limestone waste of 10 percents water-absorption from quarry to concrete plant under adverse weather conditions results in the doubling of amount of aggregate finer than 4.75 mm from ⅓ to ⅔ of the total amount of aggregate. Less water-absorption of aggregate and actual reduction of the quantity of adsorbed water means less breakdown of aggregate and more similar proportions between amounts of aggregate finer and coarser than 4.75 mm at the quarry and in the aggregate bin.

Enrichment of this by-product can be carried out by washing or screening, or by combination of washing and screening separately for parts finer and coarser than 4.75 mm with consequent mixing of these parts or without this separation. The aim of enrichment of limestone waste is reduction of small size grains and to obtain the desirable proportion between the parts of aggregate. The choice of method of enrichment depends on the results of sieve analysis of this aggregate, water-absorption of aggregate, and required grading of aggregate after enrichment.

Due to the enrichment of limestone waste, the amount of small Sizes of grains at the quarry should be reduced. The amount of aggregate finer than 2.36 mm (Sieve No.8) should not exceed about 10%, the amount of aggregate finer than 1.18 mm (Sieve No.16) should not exceed about 7%, the amount of aggregate finer than 300 $\mu$m (Sieve No.50) should not exceed about 2%. The main part of aggregate finer than 4.75 mm should be coarser than 2.36 mm. The amount of aggregate coarser than 4.75 mm after enrichment should be higher than ⅓ of the total weight of aggregate, and this excess is determined by the volume of inevitable breakdown of aggregate during the transportation to the aggregate bin of concrete plant. There are requirements of present invention for control of grading of enriched limestone waste as a coarse aggregate for concrete at the quarry after enrichment.

Transportation of enriched limestone waste from quarry to the aggregate bin of concrete plant causes the reduction of amount of large size grains and a corresponding increase of the amount of small size grains since large size grains are more vulnerable. It can make grading of this aggregate variable and even unpredictable. However, few parameters of grading of enriched limestone waste after transportation from a quarry to the aggregate bin of a concrete plant should be controlled in the framework of the present invention. The amount of aggregate finer than 4.75 mm (Sieve No.4) should be less than for the largest Size of fine aggregate Number 9 according to ASTM C33. It should be close to but not exceed ⅔ of the total weight of aggregate. The main part of aggregate finer than 4.75 mm should be coarser than 2.36 mm. The amount of aggregate finer than 300 $\mu$m (Sieve No.50) should not exceed about 3.0%. Grading of enriched limestone waste as a whole after transportation can be considered borderline between coarse and fine aggregates in Terminology of ASTM C125, i.e. between grading of Sizes Number 89 and 9 according to ASTM C33.

Experimental investigations of the washed by-product of manufacture of crushed limestone as a coarse aggregate for concrete were carried out in Moscow Institute of Concrete and Reinforced Concrete (NIIZHB). These investigations were necessary due to the shortage and high cost of crushed granite as a coarse aggregate in the Moscow region; it was attempt to find more cheap coarse aggregate at least for concrete of middle strength. Enriched limestone waste product of Lavsk quarry of Lipetsk region (350 km South East of Moscow) was used for this purpose. This is the washed by-product of the manufacture of crushed limestone of regular Russian Sizes 5–20 mm (the closest American Size is Number 67, 19–4.75 mm) and 20–40 mm defined as Russian fraction 3–10 mm.

Samples were taken from a large volume cone according to the Russian standard (very close to the similar ASTM standard) and were delivered to Institute laboratory in bags retaining quarry grading after enrichment of this aggregate. The crushing strength of limestone waste was estimated by compressing in a 150 mm-diameter cylinder. Loss of weight of tested samples made up 17%. According to the Russian building code, this loss of weight corresponds to compressive strength of coarse aggregate equal to 600 kgf/cm^2 (near 8500 psi). This is half as much as minimum strength of crushed granite Grades 1200–1400 kgf/cm^2.

Water-absorption of limestone waste is equal to 10%; specific gravity is equal to 2.46 g/cm^3; bulk density is equal to 1390 kg/m^3; the voids volume is estimated as 43%.

Frost resistance of limestone waste was determined by the tests of samples in the solution of sodium sulfate with subsequent drying. The loss of mass after 10 cycles made up 10%. According to the Russian building code, frost resistance of limestone waste is estimated as Grade F50. The content of dissoluble silica in limestone waste makes up 21 milliliters per liter.

Samples of aggregate were dried to constant weight. Averaged results of sieve analysis of enriched limestone waste as a coarse aggregate defined as fraction 3–10 mm according to the Russian building code are presented in Table 3 in the form adopted in the US building practice.

TABLE 3

| | Dimensions of Square Openings (mm) | | | | |
|---|---|---|---|---|---|
| | 12.50 | 10.00 | 5.00 | 2.50 | Less than 2.5 |
| Sieve residue (%) | 0.75 | 0.75 | 64.00 | 25.50 | 9.0 |
| Amount finer than each laboratory sieve (%) | 99.25 | 98.5 | 34.50 | 9.00 | — |

As can be seen from Table 3, grading of this aggregate considered as a quarry grading is close to that for Size number 89 as the least Size of coarse aggregate according to ASTM C33. Besides, a samples of washed finer limestone waste from a neighboring quarry defined as a 2–5 mm Russian fraction of fine aggregate of grading close to that for the largest Size of fine aggregate number 9 according to ASTM C 33 also was tested as a coarse aggregate of concrete. Physical properties of aggregates fractions 3–10 and 2–5 are the same. It was made for estimation of change of concrete strength depending on the change of grading of small grains crushed limestone used as a coarse aggregate of this concrete. Moreover, comparison of concrete strength of samples with coarse aggregate of the different grading allows estimation the change of strengths of concrete caused by a possible breakdown of this aggregate due to handling and transportation from quarry to aggregate bin of concrete plant. Results of sieve analysis of this aggregate (Russian fraction 2–5 mm) are presented in Table 4.

TABLE 4

| | Dimensions of Square Openings(mm) | | | | | | |
|---|---|---|---|---|---|---|---|
| | 5.0 | 2.5 | 1.25 | 0.63 | 0.315 | 0.16 | under 0.16 |
| Sieve residue (%) | 20.5 | 69.5 | 8.75 | 0.45 | — | — | 0.8 |
| Amount finer than each laboratory sieve (%) | 79.50 | 10.00 | 1.25 | 0.8 | 0.8 | 0.8 | |

To estimate compressive strength of concrete with washed limestone waste of fractions 3–10 and 2–5 mm as a coarse aggregate standard, cubes 10×10×10 cm were made with the use of Portland cement Brand 500-DO-N of the Oscol cement plant without admixture. According to the Russian building practice of production of precast concrete cubes were subjected to standard steam-curing according to following pattern; 3+3+6+4, i.e. 3 hrs of conditioning, 3 hrs of the temperature rise to 80° C., 6 hrs of isothermal warming, and 4 hrs of cooling. One-day compressive strength of steam-cured concrete makes up 60–65% of 28-day strength of this concrete. 28-day compressive strength of steam-cured concrete makes up 90% of 28-day strength of concrete of natural maturing. Test results of compressive strength of concrete brought to the standard European cube 15×15×15 cm and corresponding estimations of cylindrical strength (psi) are presented in Table 5. Cylindrical strength of concrete is estimated to be 1.2 times less than the cubic strength of this concrete. Concrete mixes number 1, 3, 5 were made with enriched waste defined as a Russian fraction 3–10 mm (Table 3) as a coarse aggregate, mixes number 2, 4, 6 were made with an aggregate defined as a Russian fraction 2–5 mm (Table 4) as a coarse aggregate.

TABLE 5

| | Composition of ready-mixed Concrete (kg/m^3) | | | | | | Cubic compressive strength Mpa/ Cylindrical compressive strength psi | |
|---|---|---|---|---|---|---|---|---|
| Number | Cement | Sand | Coarse aggregate | Water/ cement ratio | Density of mix (kg/m^3) | Slump (cm) | 1 day | 28 days |
| 1 | 198 | 751 | 1,068 | 1.05 | 2,225 | 6.5 | 5.8/690 | 10.0/1190 |
| 2 | 197 | 740 | 1,066 | 1.05 | 2,210 | 7.0 | 4.8/570 | 8.0/950 |
| 3 | 347 | 596 | 1,091 | 0.61 | 2,245 | 8.0 | 19.4/2,310 | 29.0/3,450 |
| 4 | 350 | 580 | 1,100 | 0.60 | 2,240 | 8.5 | 17.9/2,130 | 28.3/3,370 |
| 5 | 498 | 478 | 1,075 | 0.43 | 2,265 | 7.5 | 37.1/4,420 | 42.0/5,000 |
| 6 | 500 | 483 | 1,060 | 0.42 | 2,255 | 9.0 | 31.1/3,700 | 38.4/4,570 |

As one can see from Table 5, the use of crushed limestone of Russian fraction 3–10 mm with the grading close to that for Size No.89 as a coarse aggregate for concrete allows to achieve compressive strength of concrete in the range from 1,000 to 5,000 psi. Finer crushed limestone of Russian fraction 2–5 mm of grading close to that for the Size number 9 is less efficient as a coarse aggregate. Compressive strength of concrete with this coarse aggregate is less at least by 10% than that for concrete with coarse aggregate of grading close to that for the Size number 89.

All said above relates to concrete with coarse aggregate of washed limestone waste delivered to the Institute laboratory from the quarry without a change of its grading. It is necessary to estimate the actual breakdown of this aggregate due to transportation from quarry to plant and its impact on the concrete strength. The efficiency of the use of enriched limestone waste as a coarse aggregate in industrial conditions was checked at the Moscow plant of precast concrete No.10. Crushed limestone of the grading of Russian fraction 3–10 with water-absorption equal to 10% as a very vulnerable coarse aggregate was used for this aim. Ten double-side tipping wagons with 500 m^3 of enriched limestone waste were delivered from the Lavsk quarry to the concrete plant. Grading of this aggregate at the quarry is presented in Table 1. Results of sieve analysis of this limestone waste at the concrete plant are presented in the Table 6.

TABLE 6

| | Dimensions of Square Openings(mm) | | | | | | | |
|---|---|---|---|---|---|---|---|---|
| | 10.0 | 5.0 | 2.5 | 1.25 | 0.63 | 0.315 | 0.16 | Under 0.16 |
| Sieve residue (%) | 2.4 | 30.6 | 58.7 | 3.0 | 0.9 | 1.66 | 2.2 | 0.54 |
| Amount finer than each laboratory sieve (%) | 2.4 | 67.0 | 8.3 | 5.3 | 4.4 | 2.74 | 0.54 | — |

As can be seen from the Table 6, grading of enriched limestone waste at the concrete plant considerably differs from the grading of this aggregate at the quarry after enrichment. It changes due to loading, autumn rains, and moving by bulldozers to aggregate bin after discharge from wagons on concrete pavement of the concrete plant store. The amount of aggregate finer than 5 mm constituted near ⅓ of the total weight of aggregate before transportation to the concrete plant, while the amount of this aggregate at the concrete plant is close to the ⅔ of the total weight of aggregate. The main part of aggregate is finer than 5 mm and coarser than 2.5 mm. Grading of enriched limestone waste after transportation to the concrete plant can be considered close to intermediate between coarse and fine aggregates in Terminology of ASTM C125, i.e. between grading of Sizes number 89 and 9 according to ASTM C33.

The tests of concrete with limestone waste of this grading were carried out, the consumption of cement being the same as for prestressed piles. It was made to estimate maximum compressive strength of concrete with crushed limestone as a coarse aggregate of this grading. Concrete for piles is produced only with granite crushed stone as a coarse aggregate, and consumption of portland cement Brand 500-DO-N of the Volsk cement plant for this concrete is equal to 460 kg per cubic meter of concrete. The peculiarity of concrete for prestressed piles is the required one-day cubic compressive strength, which should be not less than 30 Mpa. This cubic strength corresponds to a cylindrical strength equal to 3570 psi. Test procedure of plant and institute laboratories is the same. Test results of concrete at the plant are presented at the Table 7.

TABLE 7

| Composition of ready-mixed concrete (kg/m^3) | | | | | | | Cubic compressive strength Mpa Cylindrical compressive strength psi | | | |
|---|---|---|---|---|---|---|---|---|---|---|
| | | | | | | | 1 day | | 28 days | |
| Number | Cement | Sand | Coarse aggregate | Water/cement ratio | Admixture (%) | Slump (cm) | $f_{cu}$ | $f_{cuavg}$ | $f_{cu}$ | $f_{cuavg}$ |
| 1 | 500 | 483 | 1060 | 0.324 | — | 6 | 20.9 | 22.60 | 29.9 | 30.60 |
| | | | | | | | 24.3 | 2,960 | 33.3 | 3,640 |
| 2 | 500 | 483 | 1060 | 0.308 | 0.5 | 7 | 21.8 | 21.10 | 30.4 | 29.45 |
| | | | | | | | 20.5 | 2,510 | 28.5 | 3,505 |
| 3 | 500 | 483 | 1060 | 0.420 | — | 8 | 20.9 | 20.65 | 39.9 | 39.45 |
| | | | | | | | 20.4 | 2,460 | 39.4 | 4,700 |
| 4 | 500 | 512 | 1110 | 0.370 | — | 6 | 23.8 | 24.50 | 46.5 | 46.05 |
| | | | | | | | 25.2 | 2,920 | 45.6 | 5,480 |
| 5 | 500 | 512 | 1110 | 0.280 | 0.3 | 6 | 41.8 | 42.00 | 46.1 | 47.75 |
| | | | | | | | 42.2 | 5,000 | 49.4 | 5,685 |
| 6 | 450 | 560 | 1110 | 0.280 | 0.3 | 6 | 35.6 | 34.80 | 40.9 | 40.40 |
| | | | | | | | 33.7 | 4140 | 39.9 | 4,810 |
| 7 | 400 | 610 | 1110 | 0.280 | 0.3 | 4 | 32.3 | 34.20 | 43.2 | 43.45 |
| | | | | | | | 36.1 | 4070 | 43.7 | 5,170 |

Three first series of test can be considered as attempts of fitting to very unusual coarse aggregate; crushed limestone was not used as a coarse aggregate on the plant. Four other series of test of this concrete should be considered as quite successful. Enriched limestone waste as a coarse aggregate after considerable breakdown caused by the handling and transportation to the concrete plant in the adverse weather conditions allows to obtain concrete of specified compressive strength up to 5,000 psi and even more.

The efficiency of enriched limestone waste of the certain grading as a coarse aggregate can be estimated by the compressive strength of concrete with this coarse aggregate. As can be seen from the Tables 5 and 7, enriched limestone waste of grading intermediate between the coarse and fine aggregate in Terminology ASTM C125 is more efficient as a coarse aggregate than crushed limestone of grading close to that for the Size Number 89 and grading close to that for the Size Number 9 according to the ASTM C33. Compressive strength of concrete with crushed limestone of this grading as a coarse aggregate is higher at least by the 10% than that for concrete of the same consumption of cement with crushed limestone of grading close to that for the Size Number 89 as a coarse aggregate. Compressive strength of this concrete is considerably higher than that for concrete of the same consumption of cement with crushed limestone of grading close to that for the Size Number 9 as a coarse aggregate. Moreover, consumption of cement for concrete with crushed limestone as a coarse aggregate of grading intermediate between the coarse and fine aggregate in Terminology ASTM C125 is less at least by the 10% than that for concrete of the same compressive strength with crushed granite of regular sizes as a coarse aggregate. One-day concrete strength exceeding the required for prestressed piles was achieved with reduction of the consumption of cement by more than ten-percent less and the twice less consumption of admixture as compared with that for concrete with crushed granite as a coarse aggregate (Tables 3 and 5).

Thus, crushed limestone in aggregate bin with the amount of aggregate finer than 4.75 mm close to but not exceeding ⅔ of the total weight of aggregate, with the amount of aggregate finer than 4.75 mm but coarser than 2.36 mm in the range 55–60% of the total weight of aggregate, and with the amount of aggregate finer than 0.3 mm not exceeding about 3% of the total weight of aggregate can be considered as a coarse aggregate of optimal grading in terms of compressive strength of concrete. This grading can be considered as intermediate between the coarse and fine aggregate in the Terminology ASTM C125. Concrete with crushed limestone of this grading as a coarse aggregate requires less consumption of cement and admixture than concrete of the same compressive strength with crushed granite and any hard rock aggregate of regular sizes as a coarse aggregates. Concrete with crushed limestone of this grading as a coarse aggregate requires less consumption of cement than concrete of the same compressive strength with crushed limestone of grading corresponding to that for Sizes Number 89 and 9 according to the ASTM C33 as a coarse aggregate.

Variation of grading of enriched limestone waste is inevitable; it is in the nature of this material. Requirements for grading of enriched limestone waste as a coarse aggregate at the quarry after enrichment and in the aggregate bin of concrete plan should limit influence of variation of grading of this aggregate on the strength of concrete. However, adverse conditions of transportation of this aggregate to the concrete plant can cause its excessive breakdown. It does not mean that enriched limestone waste of this grading can not be used as a coarse aggregate for concrete. However excessive breakdown of this coarse aggregate influences the strength of concrete. If the amount of aggregate finer than 4.75 mm exceeds ⅔ of the total weight of aggregate in the aggregate bin, it means reduction of concrete strength. Additional consumption of cement required to compensate for the degradation of this aggregate.

Tests of concrete with the different grading of crushed limestone as a coarse aggregate allow to estimate the acceptable limits of variation of grading of enriched limestone waste as a coarse aggregate in aggregate bin of concrete plant. As can be seen from the tables 5 and 7, compressive strength of concrete with crushed limestone of grading close to that for the Size Number 9 is less at least by 10% than that for concrete with crushed limestone of grading close to that for the Size Number 89. Compressive strength of this concrete is considerably less that for concrete with crushed limestone of grading intermediate between the coarse and fine aggregate in the Terminology ASTM C125. The use of enriched limestone waste of grading finer than that for the Size Number 9 as a coarse aggregate should be considered as undesirable; additional breakdown of aggregate requires non-proportional increase of consumption of cement.

Flexural strength of concrete is an important quality of concrete. As applied to the thickness design of concrete pavement, flexural strength is the main quality of concrete. Concrete with crushed limestone as a coarse aggregate of grading intermediate between the coarse and fine aggregates in the Terminology ASTM C125 can be considered as optimal in terms of flexural strength at least as compared with concrete with hard rock coarse aggregates of regular sizes. Compressive strength of concrete with this coarse aggregate is higher than that for concrete of the same consumption of cement with crushed granite of regular sizes as a coarse aggregate, and the increase of compressive strength of concrete means the increase of flexural strength of this concrete.

As the strength of any structural material flexural strength of concrete should be characterized by the specified value, design flexural strength being estimated as a part of specified flexural strength. American building code ACI 318 and documents of Portland Cement Association do not contain the definition of specified concrete flexural strength. Current of thickness design procedure of concrete pavements allows considering the modulus of rupture (MR) as a specified concrete flexural strength. According to said Portland Cement Association Engineering Bulletin (Thickness Design for Concrete Highway and Street Pavements, Portland Cement Association, EB109P), the modulus of rupture (MR) of concrete should be estimated as the average 28-day flexural strength. The value of flexural strength multiplied by 50 psi, which is less than the experimental estimation of the mean value of this strength but is nearest to it, should be chosen as the modulus of rupture (MR) of this concrete.

It is well known that flexural strength is not inherent quality of concrete as well as compressive strength. Compressive strength of concrete is the best studied quality of concrete, and it is very important to provide means for estimation of statistical characteristics of flexural strength of concrete by means of those for compressive strength of this concrete. Statistical characteristics of flexural strength of normal concrete in connection with those for compressive strength of this concrete were obtained by processing the data of the results of American tests of cylindrical compressive strength and flexural strength of concrete, and American and British tests of the compressive strength of modified cubes and the flexural strength of concrete (Sapozhnikov N. Safety of Precast Reinforced Concrete and Prestressed Structural Members by the Second Limit State (Serviceability Limit State). State Committee of Construction of the USSR Institute of Information, Moscow, 1991, Table 6, FIG. 8).

Statistical connections between compressive and flexural strength of concrete were estimated by the values of coefficient of correlation between these two types of concrete strength. Coefficients of correlation between the compressive and flexural concrete strength are equal to 0.831 and 0.865 for two big samplings of test results of 3650 standard cylinders and beams and 1107 modified cubes and standard beams, respectively. Connections between compressive and flexural concrete strength, which correspond to these values of coefficient of correlation, can be considered statistically significant. It allows the choice of modulus of rupture of concrete (MR) of concrete for thickness design of pavement depending on the specified compressive strength of this concrete.

Using the test result of 3,650 of standard cylinders and beams, the mean value of flexural strength of concrete $f_r$ can be estimated depending on the mean value of cylinder compressive strength $f_c$ as equal to $9.42\sqrt{f_c}$. This estimation of the mean value of flexural strength of concrete corresponds to the theoretical line of linear regression between compressive and flexural strength of concrete. It can be considered as legitimate at least in the range of the change of compressive strength from 2,500 to the 4,750 psi; as can be seen from the FIG. 8, theoretical and empirical lines of regression in this range of change of compressive strength coincide completely. Since the deviation of empirical line of regression from theoretical one is small up to compressive strength of concrete equal to 6,000 psi, estimation of the mean value of flexural strength equal to $9.42\sqrt{f_c}$ can be considered as legitimate in the range of change compressive strength from 2,500 to 6,000 psi.

Since the main estimation of compressive strength of concrete in American building practice is cylinder strength, the modified cube strength was assessed as cylinder by dividing by 1.2; the cubic strength of concrete is higher than that of cylindrical by 20% on average. Using the test results of 1107 of modified cubes and standard beams, the mean value of flexural strength of concrete $f_r$ can be estimated depending on the mean value of modified cubes compressive strength of this concrete $f_{cu.mod}$ is equal to $9.53\sqrt{f_{cu.mod}}/1.2$. Estimations of the mean value of the flexural strength of concrete obtained depending on the mean values of the compressive cylindrical and modified cubes strength of this concrete brought to cylindrical strength are very close and can be considered adequate.

According to said American building code ACI 318, the mean value of compressive strength of concrete fc considered as the required average strength fcr in terms of the ACI 318 must exceed the specified compressive strength $f_{c'}$ by at least $1.34s(f_c)$, where $S(f_c)$ is the standard deviation of this strength. The values of the coefficient of variation for compressive and flexural strength of concrete are assumed usually as equal to 15% (Thickness Design for Concrete Highway and Street Pavements, Portland Cement Association, EB109P, p. 34). Basing on value of coefficient of variation equal to 15%, this excess can be estimated as 25% of value of specified compressive strength $f_{c'}$. Thus, the mean value of compressive strength of concrete $f_c$ can be considered as corresponding to certain value of specified compressive strength $f_{c'}$. Due to close statistical connections between the compressive and flexural strength of concrete, mean value of flexural strength of this concrete $f_r$ estimated as $9.42\sqrt{f_c}$ can also be considered as corresponding to this value of specified compressive strength.

The value of flexural strength multiplied by 50 psi, which is less than the estimation of the mean value of this strength but is nearest to it, should be chosen as the modulus of rupture (MR) of this concrete. Values of specified compressive strength $f_{c'}$ equal to 3,000, 3,500, 4,000, 4,500 and 5,000 psi corresponds to the values of modulus of rupture (MR) equal to 550, 600, 650, 700, and 750 psi, respectively, coefficient of variation of compressive strength of concrete being assumed as 15%. These estimations of modulus of rupture of concrete are stable as to the change of coefficient of variation of compressive strength of concrete.

The large sampling of test results of 3650 standard cylinders and beams includes the 81 series of concrete samples of the same mix design. The coefficients of variation of compressive and flexural strength were estimated for all these series. The mean value of coefficient of variation of compressive strength of 81 series of test results of standard cylinder constitutes 10.95%. According to the requirements of ACI 318, required average strength should exceed specified compressive strength at least by 17%. Values of specified compressive strength $f_{c'}$ equal to 3,000, 3,500, 4,000, 4,500 and 5,000 psi corresponds to the values of the required average compressive strength equal to 3,510, 4,095, 4,680, 5,625, and 5,850 psi, respectively. The mean values of flexural strength corresponding to these values of the required average compressive strength estimated by the plot of change flexural strength of concrete depending on the change of the compressive strength (FIG. 8) are very close to 550, 600, 650, 700, and 750 psi, respectively.

As can be seen on the FIG. 8, empirical and theoretical lines of regression do not coincide in the range of change of compressive strength of concrete from 1,000 to 2,000 psi. The values of flexural strength of concrete in this range of the change of compressive strength are estimated as corresponding to the empirical line of regression. The values of compressive strength equal to 1,000, 1,500, and 2,000 psi correspond to the values of flexural strength equal to 250, 350, and 450 psi, respectively. The volume of test results in this range of the change of compressive strength is not good enough for estimation of values of modulus of rupture depending on the specified compressive strength of concrete. Because of this, the values of flexural strength equal to 300, 400, and 450 psi only approximately can be considered as the estimations of modulus of rupture corresponding to the values of specified compressive strength equal to 1,000, 1,500, and 2,000 psi, respectively.

The foregoing estimates of the values of the modulus of rupture of concrete depending on the values of specified compressive strength $f_c^1$ of this concrete are based on the test results of concrete with all types of coarse aggregate of regular sizes. Considerable part of these aggregates relates to the hard rock (gravel, crushed gravel, and crushed granite). It is well known that flexural strength of concrete with this coarse aggregate is in the range from 10 to 12 percent of compressive strength of concrete, and it increases up to the 15 percent of compressive strength for concrete with crushed limestone of regular sizes as a coarse aggregate.

It can be weighted the higher flexural strength of concrete with small grains crushed limestone as a coarse aggregate than the concrete of the same consumption of cement with crushed limestone or regular sizes as a coarse aggregate. It is possible due to more complete penetration of mortar into small grains crushed limestone and more uniform structure of concrete with this coarse aggregate than that for concrete of crushed limestone of regular sizes as a coarse aggregate. The first flexural tests of concrete with crushed limestone as a coarse aggregate of grading intermediate between that for coarse and fine aggregate in the Terminology ASTM C0125 confirm this tendency. In these tests the values of flexural strength of concrete equal to 418, 657 and 771 psi correspond to the values of compressive strength equal to 1,476, 2,821, and 4,166 psi, respectively. Flexural strength of concrete in these tests is in the range from 28.35 to 18.5 percent of compressive strength, diminishing with the increase of compressive strength. It does not mean the possibility of such estimations of modulus of rupture of concrete depends on the compressive strength of this concrete. There are only test results of the 3 series of two standard cubes brought to cylinder strength and two standard beams. However it means the tendency which should be checked during the mass production of concrete with crushed limestone of this grading for road construction.

An estimation of coefficient of variation of normal concrete strength equal to 15% is usually assumed and is incorporated into the design charts and tables of ACI and Portland Cement Association documents both for compressive and flexural strength. Concrete with enriched limestone quarry waste as a coarse aggregate is more homogenous than concrete with crushed granite and crushed limestone of regular sizes as a coarse aggregate. The degree of uniformity of this concrete can be considered as intermediate between that for normal concrete with coarse aggregate of regular sizes and mortar. It means that the coefficient of variation of strength of concrete with the enriched limestone quarry waste as coarse aggregate should be less than for concrete with coarse aggregate of regular sizes. Reduction of coefficient of variation of compressive strength of concrete means the possibility to reduce compressive average strength required according to said American building code ACI 318 with corresponding reduction of consumption of cement for this concrete.

The main peculiarity of concrete with limestone quarry waste as a coarse aggregate is the possibility of utilization of great deposits of crushed limestone finer than 9.5 mm, and especially the part of this aggregate finer than 4.75 mm. The minimum of aggregate finer than 4.75 mm before enrichment constitutes near ⅓ of the total weight of aggregate, and it corresponds to very vulnerable aggregate. The use of less vulnerable aggregate means the possibility of reduction of the amount of aggregate coarser than 4.75 mm and corresponding increase of the amount of aggregate finer than 4.75 mm before enrichment. Utilization of great deposits of limestone waste enables to reduce quarrying of high-quality aggregate with corresponding conservation of environment.

Concrete with crushed limestone of grading intermediate between the coarse and fine aggregates in the Terminology ASTM C0125 was checked in industrial conditions. Crushed limestone of this grading was used as a coarse aggregate for concrete of precast reinforced concrete temporary road slabs 1.75×3.0×0.16 mm dimensions. More than 500 of these slabs were produced on September-October 2000 at this plant. These slabs are used for access roads to buildings under construction. They are placed usually into mud without any subbase and work separately. Conditions of service of these slabs under extensive truck traffic are more than adverse. However there are no financial claims to a plant connected with the strength of those slabs.

OPERATION OF PREFERRED EMBODIMENT

The main aim of operation is to obtain concrete with enriched limestone waste as a coarse aggregate of grading optimal in terms of compressive and flexural strength of concrete. It means that in the aggregate bin of concrete plant the amount of aggregate finer than 4.75 mm should be close to but not exceed ⅔ of the total weight of aggregate, the amount of aggregate finer than 4.75 mm but coarser than 2.36 mm should be about 55–60% of the total weight of aggregate, the amount of aggregate finer than 0.3 mm should not exceed about 3% of the total weight of aggregate. Cost of aggregate finer than 9.5 mm and coarser than 4.75 mm depends on the proportion between amounts of aggregate finer and coarser than 4.75 mm before enrichment; cost of aggregate finer than 4.75 mm is considerably less than that for aggregate coarser than 4.75 mm.

Amount of aggregate finer than 4.75 mm before enrichment should be not less than ⅓ of the total weight of aggregate. It is determined depending on the breakdown of this aggregate due to handling and transportation to aggregate bin of concrete plant. Since more coarse parts of aggregate are more vulnerable due to scale effect, breakdown relates mainly to aggregate coarser than 4.75 mm. Breakdown of aggregate depends on the its water-absorption, weather conditions, conditions of handling and transportation, and should be estimated experimentally. Breakdown of aggregate of ten-percent water-absorption under adverse weather conditions, adverse conditions of handling and transportation to aggregate bin of concrete plant results in the doubling of amount of aggregate finer than 4.75 mm. Breakdown of aggregate of less water-absorption should be less, and proportions between amounts of aggregate of finer and coarser than 4.75 mm before enrichment and in aggregate bin of concrete plant should be closer. Moreover, breakdown of aggregate coarser than 4.75 mm caused by screening as a dry enrichment of aggregate should be taking into account also.

Excessive breakdown of enriched limestone waste as a coarse aggregate causes reduction of concrete strength, which should be compensated by additional consumption of cement. Grading of crushed limestone finer than that corresponding to the Size number 9 is consider as unacceptable for its utilization as a coarse aggregate since it requires the increase of consumption of cement non-proportional to the degradation of aggregate.

Enrichment can be carried out by washing or screening, or by combination of washing and screening. The aim of enrichment is reduction of is reduction of small size grains and to obtain the desirable proportion between the parts of aggregate. The choice of method of enrichment depends on the results of sieve analysis of this aggregate and the domestic conditions.

Mix design of concrete with crushed limestone of this grading should be carried out with the consumption of cement less by about 10% and twice less consumption of admixture than that required for concrete of the same specified compressive strength with crushed limestone of regular sizes as a coarse aggregate. Batch plant corrections must be made for moisture in aggregates.

CONCLUSION

Asphalt concrete pavement includes concrete subbase. Coarse aggregate of subbase and/or lower layer concrete defined as enriched limestone waste is a washed by-product of manufacture of crushed limestone of regular Sizes Number 56, 57, 6, and 67 with rated dimensions 25–9.5 mm, 25–4.75 mm, 19–9.5 mm, and 19–4.75 mm, respectively. Enrichment of this aggregate should be carried out by washing or screening, or by combination of washing and screening. Method of enrichment depends on the grading of aggregate and should be selected by economical reasons.

Limestone quarry waste as a raw material for enrichment should be coarser than 9.5 mm and finer than 4.75 mm. The amount of aggregate finer than 4.75 mm (Sieve No.4) before enrichment should be at least the value of the same order as for least Size of coarse aggregate Number 89 according to ASTM C33. It should be not less than ⅓ of total weight of aggregate. After enrichment the main part of aggregate finer than 4.75 mm should be coarser than 2.36 mm. The amount of aggregate finer than 2.36 mm (Sieve No.8) should not exceed about 10%; the amount of aggregate finer than 1.18 mm (Sieve No.16) should not exceed about 7%; the amount of aggregate finer than 300 $\mu$m (Sieve No.50) should not exceed about 2%.

Grading of this aggregate at the quarry after enrichment and in the aggregate bin of concrete plant differs due to inevitable breakdown of aggregate caused by handling and transportation from quarry to concrete plant. Due to scale effect large grains are more vulnerable, and breakdown of aggregate relates mainly to part of aggregate coarser than 4.75 mm. As a result, amount of aggregate finer than 4.75 mm after transportation to aggregate bin of concrete plant should be increased. The breakdown of aggregate should be estimated experimentally and taking into consideration when determining of proportion between parts of aggregate finer and coarser than 4.75 mm before enrichment of this aggregate.

The amount of aggregate finer than 4.75 mm in aggregate bin should be close to but not exceed ⅔ of the total weight of aggregate. The main part of aggregate finer than 4.75 mm should be coarser than 2.36 mm. The amount of aggregate finer than 300 $\mu$m (Sieve No.50) should not exceed about 2%. Grading of enriched limestone waste in aggregate bin should be finer than the least Size of coarse aggregate number 89 and coarser than for largest Size of fine aggregate number 9 according to ASTM C33. This grading can be considered as intermediate between the coarse and fine aggregates in Terminology of ASTM C125.

This grading of crushed limestone as a coarse aggregate can be considered as optimal in terms of concrete strength. Compressive strength of concrete with crushed limestone of grading corresponding to that for Sizes Number 89 and 9 as a coarse aggregate is less at least by 10% than compressive strength of concrete of the same consumption of cement with crushed limestone of this grading as a coarse aggregate. Moreover, compressive strength of concrete with crushed granite of regular sizes is less than compressive strength of concrete of the same consumption of cement and twice less consumption of admixture with crushed limestone of this grading as a coarse aggregate.

Variation of grading of enriched limestone waste is inevitable and excessive degradation of this aggregate should be considered as a possible. Excessive breakdown of aggregate does not mean impossibility of its use as a coarse aggregate for concrete. However it requires additional consumption of cement; grading of aggregate finer than corresponding to the Size Number 9 is consider as unacceptable.

Enriched limestone waste is one of the cheapest aggregates. However, use of this aggregate allows obtaining concrete of specified compressive strength $f_c'$ and modulus of rupture (MR) up to 5,000 and more than 750 psi, respectively. The use of subbase of this concrete instead of usual treated or non-treated granular subbase of asphalt pavement means the increase of capacity of this composite structural member. It means also possibility of corresponding reduction of thickness of more expensive asphalt surface course. Minimization of initial cost of pavement should be achieved by the choice of the optimal characteristics of concrete subbase and asphalt surface course by the trial-and-error method.

If rigidity of pavement is determined by the concrete subbase, flexibility of this pavement is determined by the base course. Though asphalt surface course is flexible part of asphalt pavement as a composite structural member, its flexibility is limited by rigidity of the base course. Limitation of deformations of asphalt surface course means reduction of cracking of this course and corresponding reduction of maintenance cost of this pavement.

The use of concrete with enriched limestone waste coarse aggregate for subbase and limitation of deformations of asphalt surface course with corresponding reduction of cracking of this course allow obtaining of pavement intermediate between rigid and flexible pavements. The initial cost of this pavement is close to that for flexible pavement. Its maintenance cost is higher than that for rigid pavement but considerably less than that for flexible pavement.

Moreover, the use of concrete with this coarse aggregate allows very profitable utilization of great deposits of crushed limestone finer than 9.5 mm usually estimated as limestone quarry waste and especially aggregate finer than 4.75 mm. In so doing the volume of utilized aggregate finer than 4.75 mm should constitutes at least ⅓ of the volume of utilized aggregate finer than 9.5 mm. Utilization of limestone waste enables to reduce quarrying of high-quality aggregate with corresponding conservation of environment.

The invention claimed is:

1. A semi-rigid pavement as a composite structure comprising:

an asphalt surface course;

a concrete subbase wherein the coarse aggregate of concrete is small grains crushed limestone finer than 9.5 mm of grading intermediate between the coarse and fine aggregates in the Terminology of ASTM C125 defined as enriched limestone waste;

a layer of granular material between surface course and concrete subbase, rigidity of said pavement being provided by said concrete subbase, its flexibility being provided by said asphalt surface course, the layer of granular material resting on said concrete subbase allowing the asphalt surface course to work as a flexural part of this composite structure; and said granular layer allowing the limitation of deformations and corresponding reduction of fatigue stresses and cracking of said asphalt surface course to desirable level by the choice of thickness and quality of granular material, the concrete of said subbase being characterized by specified compressive strength $f_{c'}$ and modulus of rupture (MR) up to 5,000 and more than 750 psi, respectively.

2. A pavement of claim 1 wherein said small grains crushed limestone as a coarse aggregate of concrete of subbase defined as enriched limestone waste is a processed by-product of the manufacture of crushed limestone of regular size numbers 56, 57, 6 and 67 with rated dimensions 25–9.5 mm, 25–4.75 mm, 19–9.5 mm and 19–4.75 mm, respectively, the physical properties of this coarse aggregate are in accordance with requirements of ASTM 033.

3. A pavement of claim 1 wherein the amount of concrete of subbase coarse aggregate finer than 4.75 mm should be less than that of the largest size of fine aggregate number 9 according to ASTM C33 and close to, but not exceeding, two-thirds of the total weight of aggregate.

4. A pavement of claim 1 wherein the amount of concrete of subbase coarse aggregate finer than 2.36 mm (Sieve No. 8) should not exceed about 10% of total weight of aggregate.

5. A pavement of claim 1 wherein the amount of concrete of subbase coarse aggregate finer than 1.18 mm (Sieve No. 16) should not exceed about 7% of the total weight of aggregate.

6. A pavement of claim 1 wherein the amount of concrete of subbase coarse aggregate finer than 300 $\mu$m (Sieve No. 50) in the aggregate bin of concrete plant should not exceed about 3.0% of the total weight of aggregate.

7. A pavement of claim 1 wherein the concrete of subbase of specified compressive strength $f_{c'}$ and modulus of rupture (MR) is up to 5,000 and more than 750 psi, respectively, whereas the values of the modulus of rupture (MR) of concrete equal to 550, 600, 650, 700, and 750 psi correspond to the values of the specified compressive strength $f_{c'}$ of this concrete equal to 3,000, 3,500, 4,000, 4,500, and 5,000 psi, respectively.

8. A pavement of claim 1 wherein said concrete of subbase with small grains crushed limestone finer than 9.5 mm as a coarse aggregate of grading intermediate between the coarse and fine aggregates in the Terminology of ASTM C125 and defined as enriched limestone waste is characterized by compressive strength higher at least by 10% and up to 20% than that of concrete of the same consumption of cement with crushed limestone as a coarse aggregate of grading corresponding to the least size of coarse aggregate No. 89 and largest Size of fine aggregate No. 9 according to ASTM C33, respectively.

9. A pavement of claim 1 wherein concrete of said subbase with small grains crushed limestone finer than 9.5 mm as a coarse aggregate of grading intermediate between the coarse and fine aggregates in the Terminology of ASTM C125 and defined as enriched limestone, waste is characterized by compressive strength higher or at least close to that of concrete of the same consumption of cement and twice as high consumption of admixture with crushed granite of regular sizes as a coarse aggregate while the flexural strength of this concrete is higher than that for concrete of the same consumption of cement with crushed granite of regular sizes as a coarse aggregate.

10. A semi-rigid pavement as a composite structure comprising:

an asphalt surface course;

a concrete subbase wherein the coarse aggregate of said concrete is small grains crushed limestone finer than 9.5 mm defined as enriched limestone waste; and a layer of granular material between said surface course and said concrete subbase;

wherein said layer of granular material resting on said concrete subbase permits said asphalt surface layer to function as a flexural part of said composite structure with resulting reduction of fatigue stress and cracking of said asphalt surface course.

11. A semi-rigid pavement as claimed in claim 10 wherein said crushed limestone is of grading intermediate between coarse and fine aggregates in terminology of ASTM C125 and defined as enriched limestone waste.

12. A semi-rigid pavement as claimed in claim 10 wherein the concrete f said subbase is characterized by specified compressive strength $f_c^1$ and modulus of rupture (MR) up to 5000 psi and more than 750 psi, respectively.

* * * * *